US005345883A

United States Patent [19]

Panos

[11] Patent Number: 5,345,883

[45] Date of Patent: Sep. 13, 1994

[54] REACTIVATION OF SORBENT IN A FLUID BED BOILER

[75] Inventor: Paul J. Panos, Windsor, Conn.

[73] Assignee: Combustion Engineering, Inc., Windsor, Conn.

[21] Appl. No.: 998,993

[22] Filed: Dec. 31, 1992

[51] Int. Cl.[5] ..... F23J 15/00

[52] U.S. Cl. ..... 110/345; 110/245; 122/4 D; 422/144; 502/514

[58] Field of Search ..... 122/4 D; 110/245, 347, 110/345; 431/7; 422/144; 165/104.16; 502/514

[56] References Cited

U.S. PATENT DOCUMENTS

| | | | |
|---|---|---|---|
| 4,312,280 | 1/1982 | Shearer et al. | 110/347 |
| 4,476,816 | 10/1984 | Cannon et al. | 122/4 D |
| 4,828,486 | 5/1989 | Sakamoto et al. | 122/4 D |
| 5,048,432 | 9/1991 | Hofmann et al. | 110/345 |

*Primary Examiner*—Edward G. Favors

*Attorney, Agent, or Firm*—Chilton, Alix & Van Kirk

[57] ABSTRACT

A circulating fluidized bed combustion process which uses a sorbent to react with sulfur oxides employs a process for fracturing the sorbent particles to expose unreacted sorbent in the core of the particles to increase the sorbent utilization. The particles within the circulating bed are fractured by injecting water either as a liquid or as steam.

3 Claims, 2 Drawing Sheets

REACTIVATION OF SORBENT IN A FLUID BED BOILER

BACKGROUND OF THE INVENTION

The present invention is directed to the combustion of a fuel in a fluidized bed system, particularly a circulating fluidized bed system, and relates to the reactivation of the sorbent material to increase its utilization.

Fluidized bed combustion has gained favor for a number of reasons. An important feature is its ability to burn high-sulfur fuels in an environmentally acceptable manner without the use of flue gas scrubbers. In fluidized bed combustion, much of the sulfur contained in the fuel is removed during combustion by a sorbent material in the fluid bed, usually limestone. Also, in this process, the production of nitrogen oxides is low because of the low temperatures at which the combustion takes place.

One type of fluidized bed combustion is the circulating fluidized bed system. In this system, the gas velocities in the combustor are three to four times as high as in a bubbling fluidized bed system. The particles of sorbent are carried up through and out of the combustor section of the system. The flue gas containing the solid particles is then fed to a separator where the solid particles are separated from the gas by a cyclone. In one arrangement, the solids discharged from the bottom of the cyclone pass through a seal pot, syphon seal or L-valve with a significant portion of the solids going to a solids heat recovery system. The remainder of the solids is reinjected directly back into the combustor. In another arrangement, all solids discharged from the bottom of the cyclone are reinjected directly back into the combustor. In a third arrangement all solids discharged from the bottom of the cyclone are reinjected into the combustor by way of the solids heat recovery system.

In such systems, the limestone is typically fed into the combustor as a separate sorbent feed. In the process, the limestone is calcined to form calcium oxide, CaO, which then reacts in the combustor with the oxides of sulfur forming calcium sulfate, $CaSO_4$. Both the CaO and the $CaSO_4$ are in solid form at the operating conditions of a fluidized bed. Since the sulfur oxides react with the CaO on the surface of the sorbent particles, the end result is solid particles with a core of unreacted CaO and an outer layer of $CaSO_4$. The unreacted CaO core is prevented from reacting due to the outer surface layer of $CaSO_4$ because the gaseous sulfur oxides cannot effectively penetrate to the core. The consequence is the requirement of an excess of limestone over what would be stoichiometrically required for any given level of sulfur removal and the under utilization of the limestone. This process also can be used within a bubbling fluidized bed.

SUMMARY OF THE INVENTION

An object of the present invention is to provide a process for increasing the utilization of sorbent in a fluidized bed combustion system and involves the break-up or fracture of reacted sorbent particles having a core of unreacted sorbent material. More specifically, an object is to break-up or fracture the sorbent particles which have a core of unreacted CaO and a surface of $CaSO_4$ to expose and utilize the unreacted CaO core by means of water or steam introduction to create mechanical and/or thermal shock.

DESCRIPTION OF THE PREFERRED EMBODIMENTS

Figure 1:
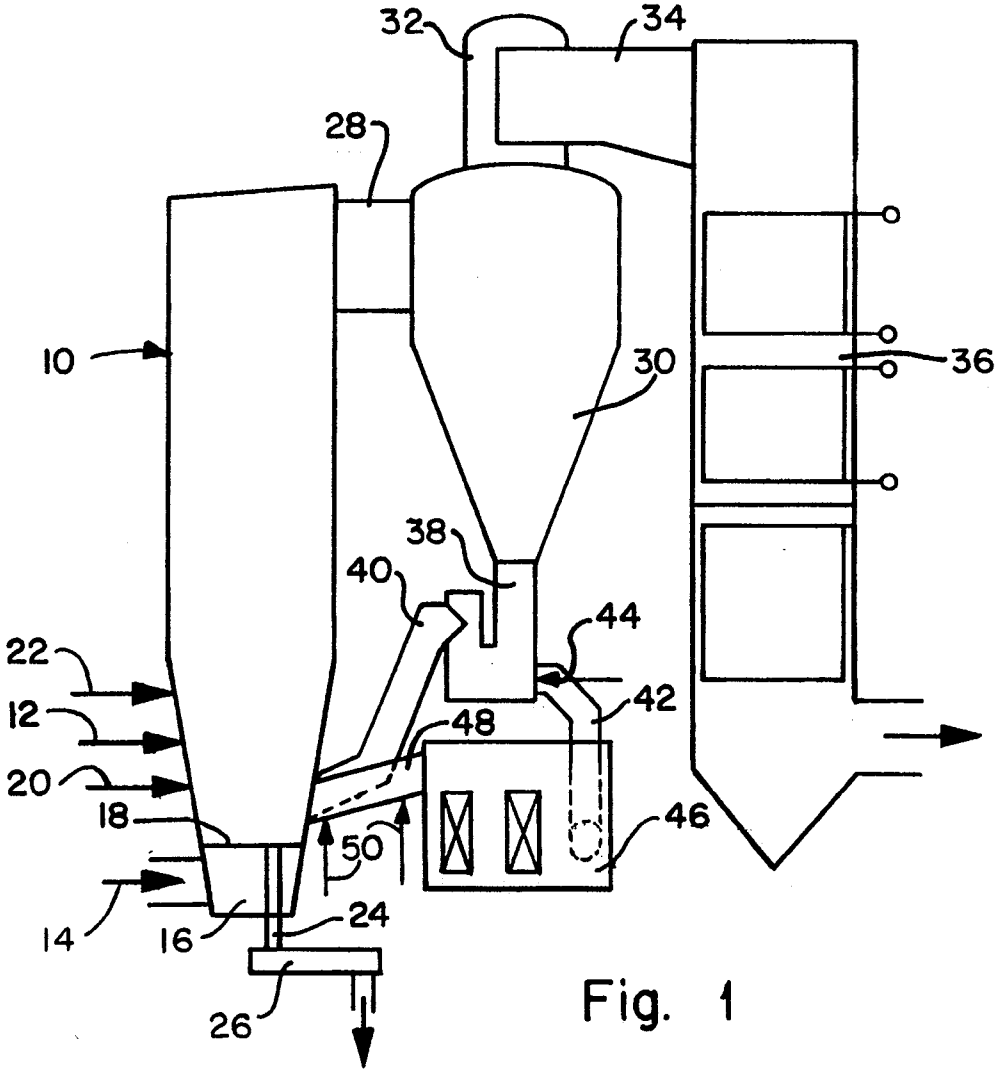
FIG. 1 is an illustration of a circulating fluidized bed steam generator system incorporating the present invention.

Referring to the drawing which illustrates a typical circulating fluidized bed combustion system, the combustor or combustor is shown at 10. Fuel, usually coal, and sorbent, usually limestone, are fed pneumatically to the combustor 10 at 12. The primary fluidizing air 14, which has been preheated, is fed to the air plenum chamber 16 in the bottom of the combustor below the air distribution plate 18. Additional combustion air is fed into the combustor at 20 and 22. Ash is removed from the combustor through the pipe 24 and throughthe ash cooler 26. The bottom portion of the combustor 10 is normally refractory lined to eliminate high heat losses in the primary combustion zone. The upper portion of the combustor contains evaporative waterwalls tubes in which the steam is generated. The flue gas and the solids which are carried along with it from the combustor 10 pass through duct 28 to the cyclone separator 30. In the separator, the solids are separated from the flue gas with the solids going to the bottom of the separator and the flue gas out the central duct 32 in the top. The flue gas then flows through tangential duct 34 to the convection pass 36 of the steam generator which contains the typical heat exchange surfaces.

On the bottom of the cycline separator 30 is a J-leg or sealpot 38. This serves to move solids collected in the bottom of the separator 30 back into the combustor 10 against the combustor pressure. Solids flow down on the inlet (right) side, up the outlet (left) side and then back to the combustor in duct 40. The bottom portion of the sealpot is normally fluidized to permit the material in the sealpot to flow through it. The difference in ash level betwen the inlet and outlet sides corresponds to the pressure differential across the sealpot. Solids entering the inlet side displace the solids flowing out of the outlet side into duct 40.

Located in the lower portion of the sealpot 38 is a solids withdrawal pipe 42 including a solids flow control valve 44. The pipe 42 feeds the desired portion of the hot recirculating solids from the sealpot to the heat recovery fluid bed system 46. This is a bubbling bed heat exchanger consisting of one or more compartments with most compartments containing immersed tube bundles such as evaporative, reheated steam, superheated steam, and economizer heat exchangers. Some compartments may be empty. The hot solids enter the heat recovery fluid bed system 46 where they are fluidized and transfer heat to the heat exchange surface as they gradually pass from one compartment to the next. The solids then flow out through the outlet pipe 48 and back to the combustor 10.

The solids which are circulating around the system through the combustor 10, the separator 30 and the heat recovery fluid bed 46 are a mixture of unreactive coal ash and the particles of sorbent which have only partially reacted as previously described. They will have the core of unreacted CaO and the shell or outer layer of $CaSO_4$. According to the present invention, these particles are broken-up or fractured by introducing water into the bed, either as liquid or steam, to mechanically and/or thermally shock the particles. The temperature of the particles, before mixing with water or steam, is normally between 315° C. (600° F.) and 982° C. (1800° F.) Liquid water injected at a lower temperature acts to thermally shock the particles causing them to fracture. Furthermore, the rapid expansion of the water to steam mechanically breaks up the particles. Steam, if cold enough compared to the temperature of the particles, also thermally shocks the particles.

Steam or water introduced at a high pressure also acts to mechanically break up the particles. The steam or water can also be directed in such a manner as to force the bed of particles against a hard surface, such as refractory or metal, or against each other, with sufficient velocity to cause the particles to mechanically break apart, as shown in FIGS. 2 to 4.

The liquid water or steam may be at any pressure which is greater than the system pressure at the point of introduction. Any quality of water or steam may be used and it may be introduced as part of a slurry such as a slurry of sorbent, ash or fuel. It may be introduced at any location in the system where there are circulating particles containing the unreacted CaO in combination with the coating of $CaSO_4$. For example, but not by way of limitation, it could be introduced into the combustor, the cyclone separator, the heat recovery fluid bed system, the sealpot or L-valve, or any of the connecting ducts. For purposes of illustration, the drawing shows the introduction being in the outlet duct of the fluid bed heat exchanger 48 at multiple points 50.

Figure 2:
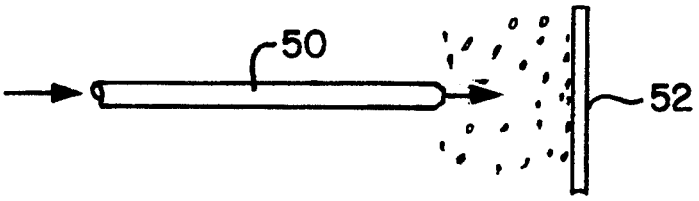
FIGS. 2 to 4 illustrate various methods of causing particles to impinge upon a surface or upon each other.
Figure 3:
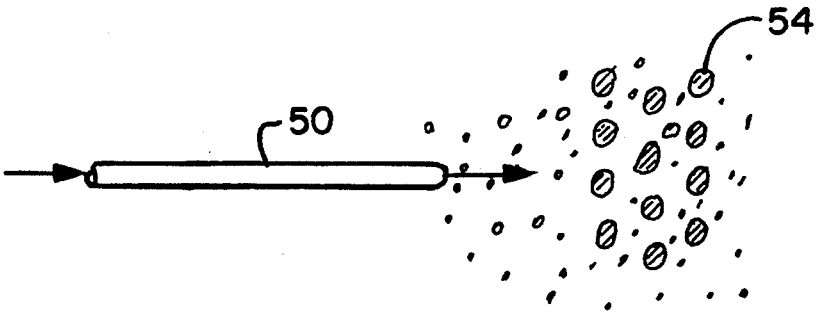
Figure 4:
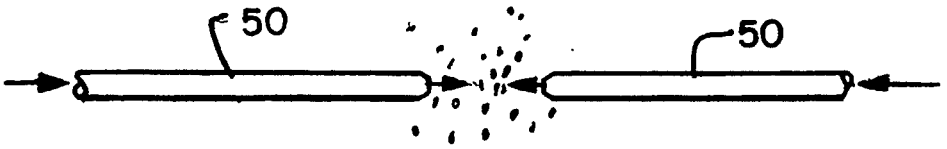

FIGS. 2 to 4 illustrate alternate ways of introducing the steam or water medium so as to impinge the particles against a hard surface or against each other. In FIG. 2, the jet of steam or water forces the particles against a plate 52 which could be either flat or curved. Alternately, the surface 52 could be in the form of a box which becomes filed with particles. In FIG. 3, the particles are forced to impinge upon a target arrangement of bars or pipes 54 of any desired cross-section. In both the FIG. 2 and 3 arrangements, the inlet pipe 50 could be anywhere from 1 to 24 inches away from the plate 52 or bars 54. FIG. 4 illustrates opposing jets which force the particles to impinge against each other to cause the fracturing. The pipes 50 in FIG. 4 could be from 1 to 24 inches apart.

I claim:

1. In a circulating fluidized bed combustion process for burning a sulfur-containing fuel in a circulating bed of fluidized sorbent particles in a combustor to generate flue gas and sulfur dioxides, separating the generated flue gas from the circulating particles and returning the separated particles to the combustor wherein the sulfur oxides react with sorbent material on the surface of said sorbent particles and wherein unreacted sorbent material remains inside said particles, the improvement comprising injecting a jet of fracturing medium of liquid water or steam at a sufficiently high pressure and direcrted so as to impinge upon said sorbent particles containing unreated sorbent material inside whereby said sorbent particles are mechanically fractured to expose said unreacted sorbent material to said sulfur oxides.

2. In a process as recited in claim 1 wherein said fracturing medium is at a temperature lower than the temperature of said sorbent particles at the point of injection thereby causing thermal shock.

3. In a process as recite in claim 1 wherein said fracturing medium is directed such that bed particles containing sorbent are caused to be mechanically broken apart by striking a target surface or other bed particles.

* * * * *

UNITED STATES PATENT AND TRADEMARK OFFICE

CERTIFICATE OF CORRECTION

PATENT NO. : 5,345,883

DATED : September 13, 1994

INVENTOR(S) : Paul J. Panos

It is certified that error appears in the above-indentified patent and that said Letters Patent is hereby corrected as shown below:

Claim 1, column 4, line 23, change "direcrted" to --directed--.

Claim 1, column 4, line 24, change "unreated" to --unreacted--.

Claim 3, column 4, line 33, change "recite" to --recited--.

Signed and Sealed this

Twentieth Day of June, 1995

Bruce Lehman

*Attest:*

BRUCE LEHMAN

*Attesting Officer*

*Commissioner of Patents and Trademarks*